US008648891B2

(12) United States Patent
Terrill et al.

(10) Patent No.: US 8,648,891 B2
(45) Date of Patent: Feb. 11, 2014

(54) PRINTER WITH PIVOTALLY OVERLAPPING DISPLAY AND COVER

(75) Inventors: Andrew B. Terrill, Prairie du Sac, WI (US); David N. Woods, Madison, WI (US); Matthew T. Woerpel, Lodi, WI (US); John Grosz, Waupan, WI (US); Michael Brock, Sun Prairie, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 98 days.

(21) Appl. No.: 13/189,720

(22) Filed: Jul. 25, 2011

(65) Prior Publication Data

US 2013/0027497 A1 Jan. 31, 2013

(51) Int. Cl.
*B41J 2/32* (2006.01)

(52) U.S. Cl.
USPC ..... 347/222

(58) Field of Classification Search
USPC ..... 347/220, 222
See application file for complete search history.

(56) References Cited

U.S. PATENT DOCUMENTS 4,109,821 A * 8/1978 Lutz ..... 220/836
5,364,196 A † 11/1994 Baitz
5,511,891 A † 4/1996 Nehowig
7,542,284 B1 † 6/2009 Wilson, Sr.
D658,227 S † 4/2012 Schoenert

OTHER PUBLICATIONS

DuraNews, "New Duralable Toro" by Steve Stephenson published on Jun. 7, 2011, viewable at: http://duralabel.com/duranews/2011/jun/whats-new-new-duralabel-toro-integ rated-portable-system.*
Brady, BBP31 Sign & Label Printer: Brochure.
Brady, BBP31 Sign & Label Printer: Sell Sheet.
Brady, BBP31 Sign & Label Printer: User's Manual.
Duralabel, Toro: Portable Integrated Printer (www.duralabeltoro.com) (printed Jul. 13, 2011).
U.S. Appl. No. 12/400,255, filed Sep. 9, 2010, Taylor.†
Graphic Products, Inc. duralabel.com Web Archive May 30, 2011.†
Graphic Products, Inc. Duralabel Toro Print & Web Insert May 30, 2011.†
Graphic Products, Inc. Duralabel Toro Battery Guide Jun. 9, 2011.†
Affidavit of Aron Stephenson Authenticating Above Cites.†

* cited by examiner
† cited by third party

*Primary Examiner* — Huan Tran
(74) *Attorney, Agent, or Firm* — Quarles & Brady LLP

(57) ABSTRACT

A printer comprises a body, a display pivotally coupled to the body, and a cover pivotally coupled to the body. The display and the cover can be positioned relative to each other such that the cover overlaps the display when the display is not in use.

20 Claims, 7 Drawing Sheets

PRINTER WITH PIVOTALLY OVERLAPPING DISPLAY AND COVER

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

The present invention relates to printers, and more particularly to printers having a pivotal cover that can be moved to overlap an adjacent pivotal display.

Printers are typically designed to have an efficient form factor (e.g., compact, minimal "footprint," etc.) while simultaneously establishing desired ergonomics (e.g., convenient controls/user interface). However, these aspirational design constraints are often at odds because reducing the size/weight of a printer may negatively influence the ergonomics of, for instance, the accompanying user interface (e.g., printer controls, display, etc.). As one example, a portable printer is preferably configured to minimize its overall form factor to improve the process of transporting the printer between worksites. However, reducing the form factor of the printer typically hampers the ergonomics because, for instance, a built-in keyboard and/or display are also reduced in size, thus making interaction with the printer more tedious and time consuming.

The initial shipping and subsequent transportation of a printer presents further challenges to designing a robust yet ergonomic printer. Printers, and particularly those incorporating a built-in display, are susceptible to damage during shipping and transportation. Therefore, care must be exercised in configuring the packaging (e.g., the outer cardboard box and the inner packaging materials) to adequately protect and insulate the printer from the potential damage that may occur during shipping. This packaging requires additional development efforts, increases material cost, and produces additional waste when the packaging is discarded.

The subsequent transportation of the unpackaged printer (e.g., a portable printer that is designed to be moved between worksites) provides further undesirable opportunities for the printer to be damaged. One approach to prevent or reduce damage to the printer during transport includes placing the printer in a padded bag or other protective container. However, this approach presents additional cost, requires increased transportation space, and may not adequately protect particularly susceptible parts of the printer (e.g., a display).

In light of at least the above, a need exists for an improved printer having an efficient, ergonomic, and robust design.

SUMMARY OF THE INVENTION

The printer concept described includes a body, a display pivotally coupled to the body, and a cover pivotally coupled to the body. The display and the cover can be positioned relative to each other such that the cover overlaps the display when the display is not in use.

In one aspect, a printer comprises a body, a display pivotally coupled to the body and moveable between a storage position and a viewable position, and a cover pivotally coupled to the body and moveable between a transport position and a control position. The cover overlaps the display when the display is in the storage position and the cover is in the transport position.

In another aspect, a printer comprises a body defining a side, a display pivotally coupled to the body adjacent to the side, and a cover pivotally coupled to the body adjacent to the side. The display can be pivoted to be substantially parallel with the side, and the cover can be pivoted to overlap the display such that when the display is substantially parallel with the side the display is positioned between the side of the body and the cover.

In a further aspect, a printer comprises a body, a display defining a display plane, and a cover defining a cover plane. The display is pivotally coupled to the body to pivot between a storage position and a viewable position, and the cover is pivotally coupled to the body to pivot between a transport position and a control position. When the display is in the storage position and the cover is in the transport position, the display plane and the cover plane are substantially parallel such that the cover overlaps the display. And, when the display is in the viewable position and the cover is in the control position, the display plane and the cover plane intersect to define an obtuse angle.

In yet another aspect, a printer comprises: a body having a side and an end face that is oriented substantially perpendicular to the side; a recess defined in the side; a media output passage defined in the end face; a touch screen display having a screen and a rear panel adjacent to the screen, the touch screen display is pivotally coupled to the body adjacent to the side; and a keyboard having a key pad and a bottom panel adjacent to the key pad, the keyboard is pivotally coupled to the body adjacent to the side. The touch screen display is moveable between a storage position at which the touch screen display is at least partially received in the recess, and a viewable position at which the touch screen display is skewed relative to the side. The keyboard is moveable between a transport position at which the keyboard is adjacent to the side, and a control position at which the keyboard is skewed relative to the side. When the touch screen display is in the storage position and the keyboard is in the transport position the rear panel is adjacent to the recess and the key pad is adjacent to the screen such that the keyboard overlaps and at least partially encases the touch screen display in the recess between the side of the printer and the bottom panel of the keyboard.

These and still other aspects will be apparent from the description that follows. In the detailed description, preferred example embodiments will be described with reference to the accompanying drawings. These embodiments do not represent the full scope of the concept; rather the concept may be employed in other embodiments. Reference should therefore be made to the claims herein for interpreting the breadth of the invention.

DETAILED DESCRIPTION OF THE PREFERRED EXAMPLE EMBODIMENT

The example printer described is in the form of a portable, thermal transfer printer that is generally configured to print signs and labels; however, as one skilled in the art will appreciate when given the benefit of this disclosure, the inventive concepts described can be incorporated with any other form of printer, such as the various printers manufactured by Brady Worldwide, Inc. of Milwaukee, Wis. Furthermore, throughout the description, terms such as front, back, side, top, bottom, up, down, upper, lower, inner, outer, above, below, left, right, and the like are used to describe the relative arrangement and/or operation of various components of the example embodiment; none of these relative terms are to be construed as limiting the construction or alternative arrangements that are within the scope of the claims.

Figure 1A:
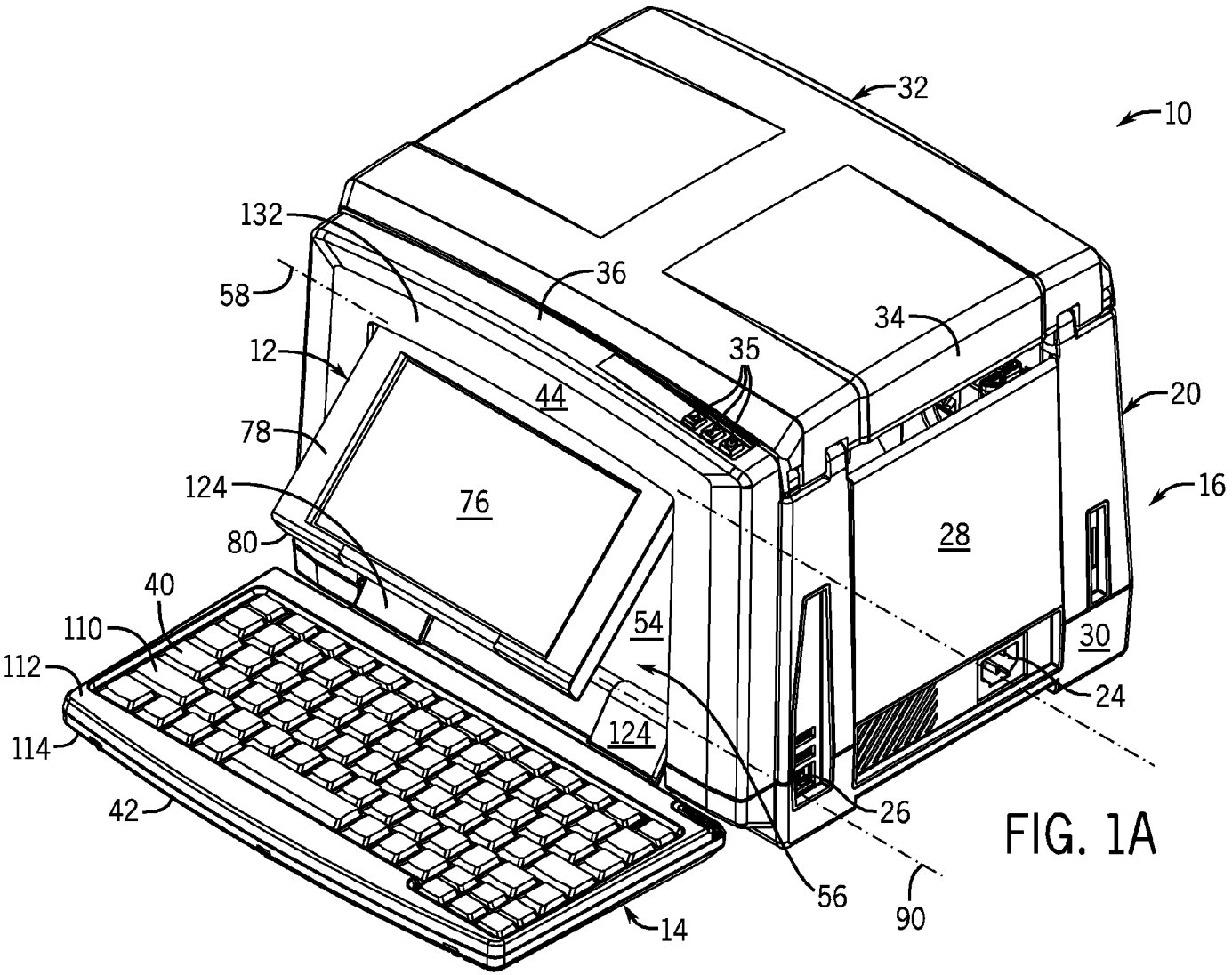
FIG. 1A is an isometric view of an example printer showing an example display in a viewable position and an example cover in a control position.
Figure 1B:
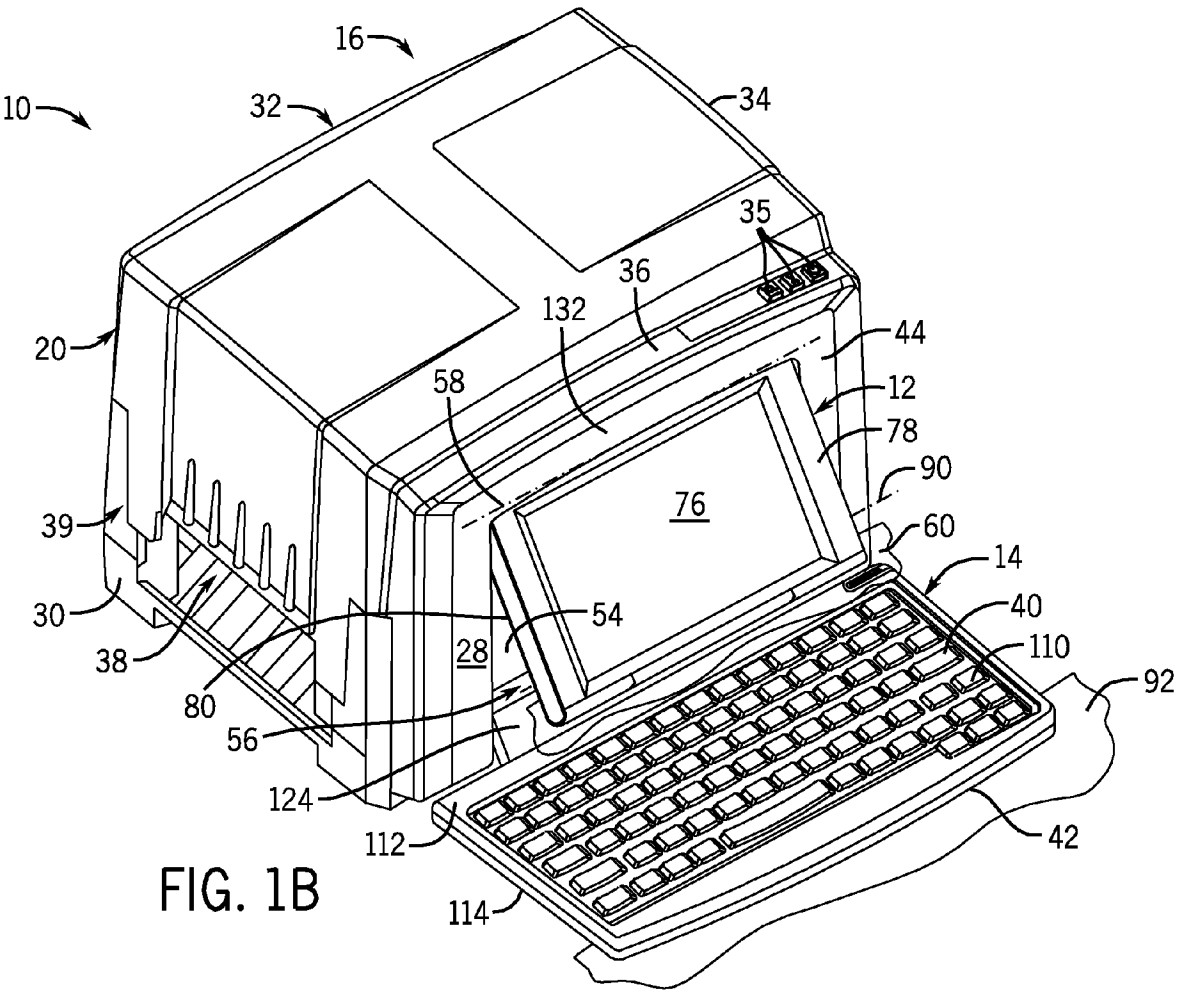
FIG. 1B is another isometric view of the example printer illustrated in FIG. 1A showing the example display in the viewable position and the example cover in the control position.

With initial reference to FIGS. 1A and 1B, an example printer is illustrated in the form of a portable sign and label printer ("printer (10)"). The printer (10) is configured to allow a user to print custom signs and labels on a variety of print media (e.g., adhesive-backed labels, tubing, wire markers, and the like). For example, the printer (10) includes a display in the form of an interactive touchscreen display interface ("touchscreen display (12)") and a cover in the form of an interactive keyboard ("keyboard (14)"). The touchscreen display (12) and the keyboard (14) are engaged by the user to, for instance, select desired print options, enter alphanumeric information, and manage operation of the printer (10).

In the example embodiment, the touchscreen display (12) and the keyboard (14) are each pivotally coupled to the balance of the printer (10). During operation of the printer (10), the touchscreen display (12) and the keyboard (14) can be adjusted to enhance ergonomics, such as by angling/skewing the touchscreen display (12) for comfortable viewing and by moving the keyboard (14) for convenient interaction. During storage and/or transportation of the printer (10), the touchscreen display (12) can be folded down (e.g., see FIG. 3) and the keyboard (14) can be folded up (e.g., see FIG. 4) to overlap the touchscreen display (12), thereby enhancing the robustness of the printer (10) and providing increased protection of the touchscreen display (12) and the keyboard (14). In alternative forms, a display and a cover may be folded in from the left and the right, respectively, or may be arranged to both fold down or up about a common pivot axis. In still other forms, while the example display and cover are illustrated as being directly coupled to the body, a cover may be indirectly coupled to the body by being pivotally coupled to a display that is in turn pivotally coupled to the body. Given the benefit of this disclosure, one skilled in the art will appreciate the various relative couplings available to directly or indirectly pivotally couple the display and cover to the body.

Figure 2:
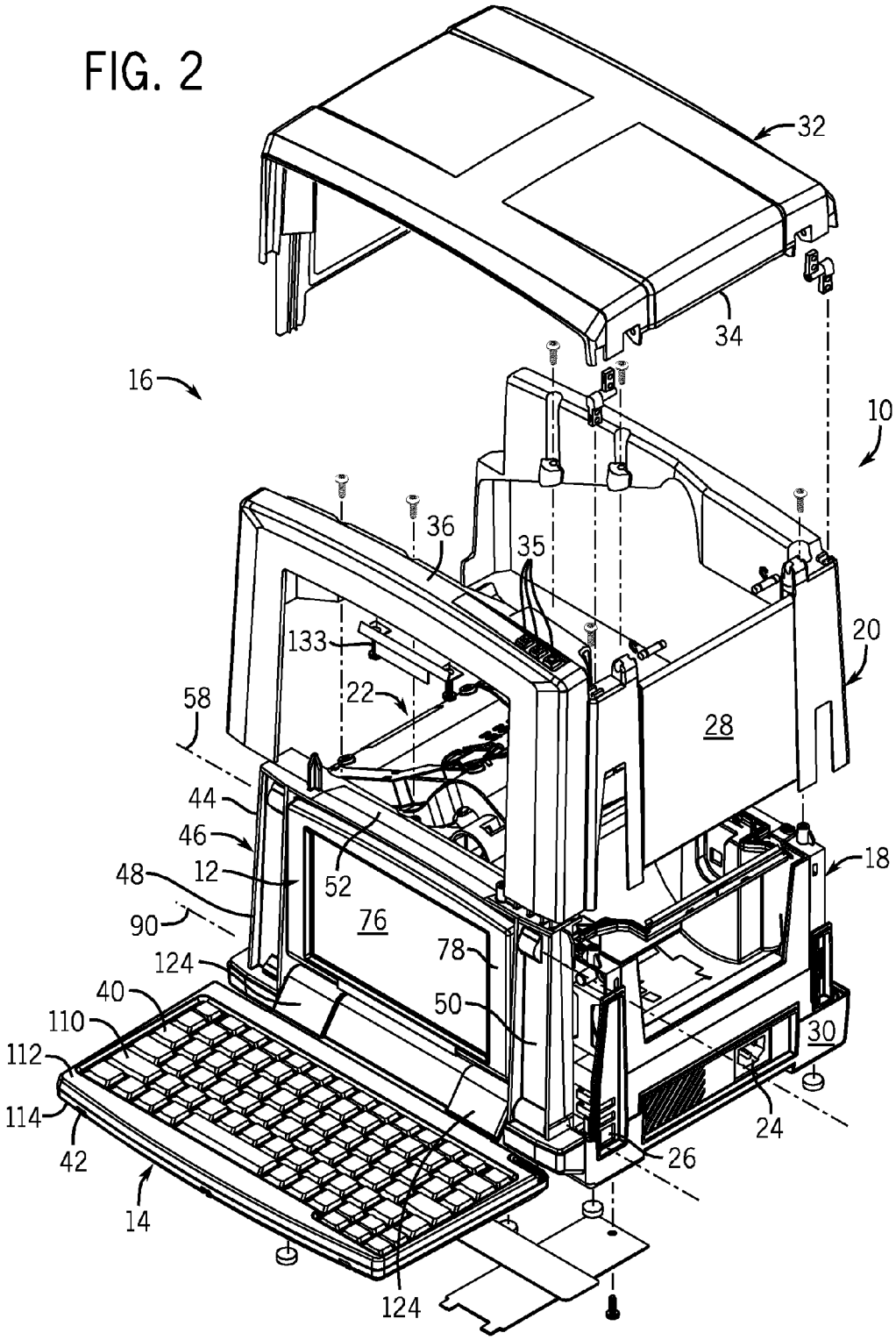
FIG. 2 is an isometric, exploded view of the example printer illustrated in FIG. 1.

With additional reference to FIG. 2, the structure and operation of the example printer (10) is described in detail; for conciseness, the particulars of the structure and operation of the printer (10) that are generally understood by one of ordinary skill are not repeated. The printer (10) has a body (16) including a frame (18) and a housing (20). The frame (18) provides the general structural support for the various components of the printer (10), such as a print mechanism (22). The print mechanism (22) may include, for example, power control electronics, control circuitry, sensors, a print head, a print media cartridge, a ribbon cartridge, a cutter assembly, and associated drive mechanisms (e.g., a platen roller, an idler roller, etc.). The example printer (10) also includes a power port (24) for receiving a power cord (not shown) and connectivity ports (26) (e.g., universal serial bus ports, local area network ports, etc.) for communicating with peripheral devices.

The housing (20) of the printer (10) includes an outer shell (28) seated on top of a generally rectangular base plate (30). An L-shaped cover (32) is hinged at an end (34) to the outer shell (28); the cover (32) can be pivoted from a closed position to an opened position to allow access to the print mechanism (22). The base plate (30), the outer shell (28), and the print mechanism (22) may be selectively coupled by conventional devices, such as screws, clips, and the like.

As one skilled in the art will appreciate, the overall control and operation of the printer (10) may be in accordance with standard printer design (with any modifications necessary to implement the inventive concepts). For instance, a controller may be incorporated to control the operation of various motors in response to sensors and instructions programmed through the printer controls. In other forms, the printer (10) may be in communication with a separate device (e.g., a portable computer or hand-held device) to receive commands or instructions. The example printer (10) also includes buttons (35) along an upper surface (36) of the outer shell (28) that allow the user to manually power on/off the printer (10), selectively feed print media through the printer (10), and actuate the cutter assembly (not shown) to cut the print media.

Furthermore, given the benefit of this disclosure, the basic operation of the example printer (10) will be understood by one of ordinary skill in the art. In general, print media (not shown), such as adhesive-backed labels, tubing, paper, plastic wire marker sleeves, and the like, is fed adjacent the print head as it is unwound from the print media cartridge. The print head interacts with the ribbon cartridge to print upon the print media. The print media is then directed downstream toward the cutter assembly whereat the print media may be cut or scored before being directed out of the printer (10) through a media output passage (38) defined in an end face (39) of the printer (10) (shown only in FIG. 1B).

Figure 3:
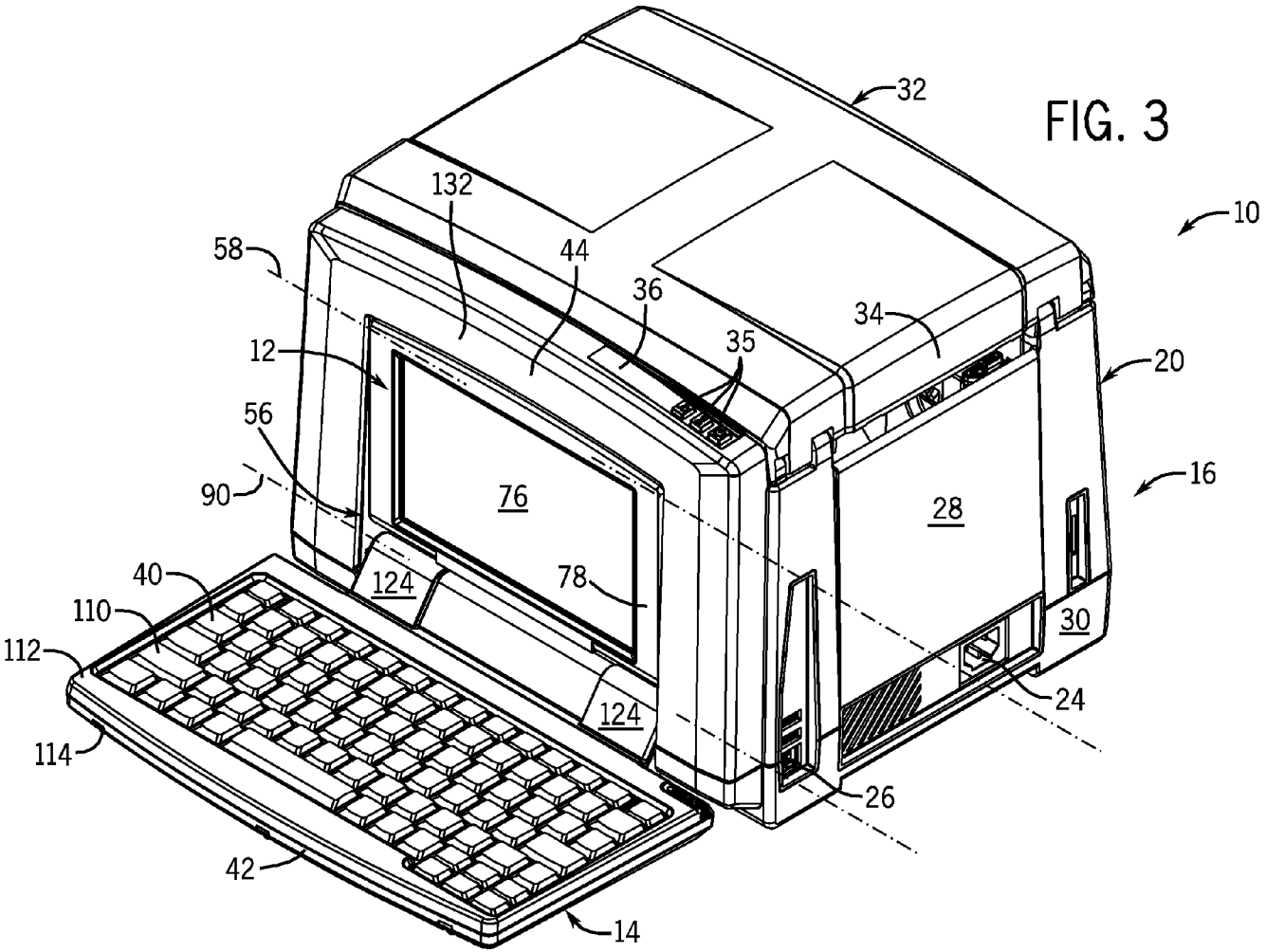
FIG. 3 is an isometric view of the example printer illustrated in FIG. 1 showing the example display in a storage position.
Figure 4:
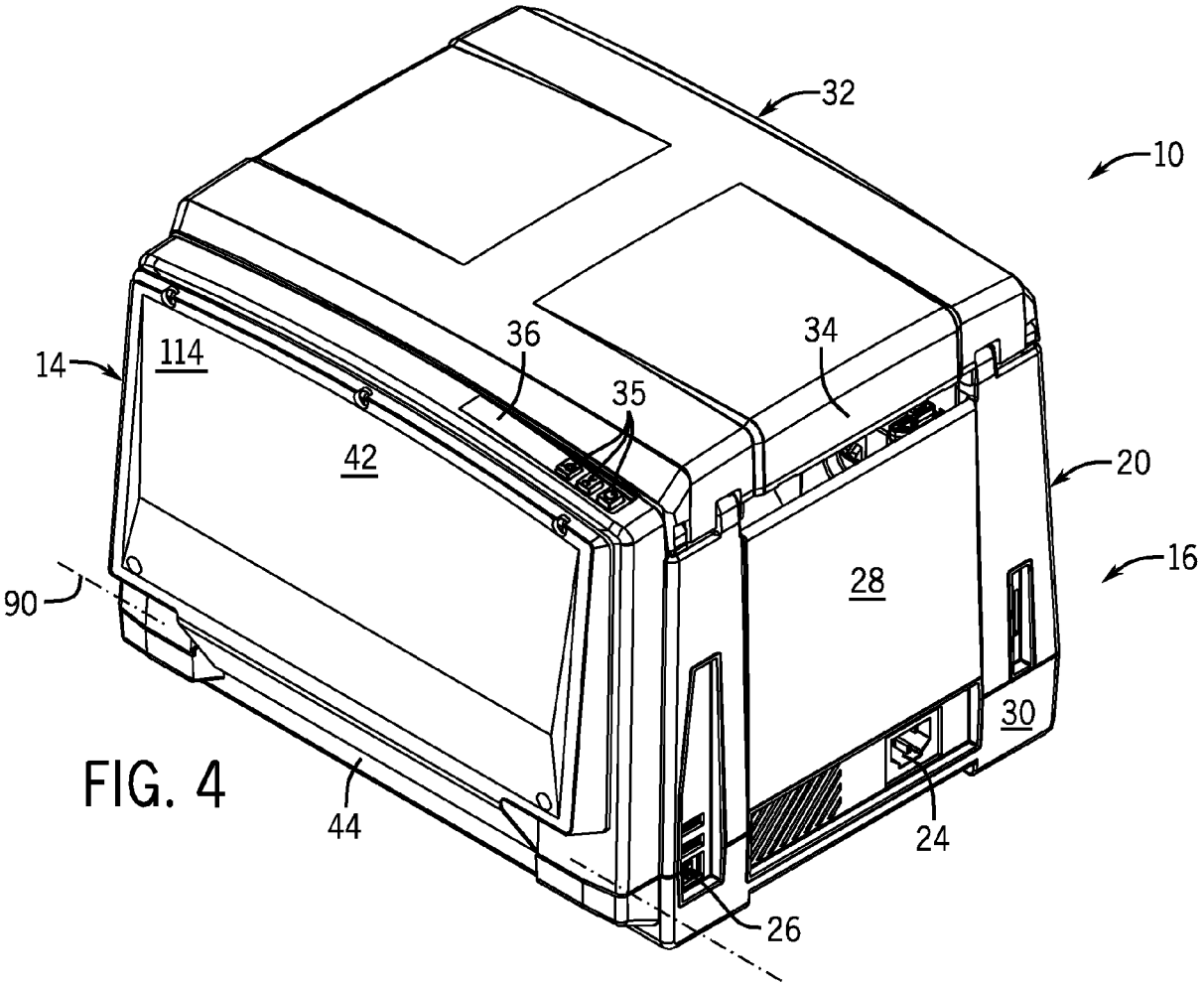
FIG. 4 is an isometric view of the example printer illustrated in FIG. 1 showing the example cover in a transport position and overlapping the example display in the storage position.

Returning to the pivotal aspects of the printer (10), as noted above, the example printer (10) includes the touchscreen display (12) and the keyboard (14) that are both pivotally coupled (e.g., directly) to the body (16) such that the keyboard (14) can be positioned to overlap the touchscreen display (12) when the printer (10) is not in use. The example operation of the touchscreen display (12) and the keyboard (14) is best shown in FIGS. 1A, 3, and 4. Specifically, FIGS. 1A, 3, and 4 illustrate various relative orientations as the touchscreen display (12) is moved between a viewable position (shown in FIG. 1A) and a storage position (shown in FIG. 3), and the keyboard (14) is moved between a control position (shown in FIG. 1A) and a transport position (shown in FIG. 4). As shown in FIG. 4, the keyboard (14) overlaps the touchscreen display (12) when the touchscreen display (12) is in the storage position and the keyboard (14) is in the transport position, thereby helping to protect the touchscreen display (12) and the key side (40) of the keyboard (14) during, for instance, storage, shipping, and transportation of the printer (10). When the keyboard (14) is in the transport position, a back side (42) of the keyboard (14) forms an exterior surface of the printer (10). The back side (42) of the keyboard (14), therefore, is preferably made of a robust, resilient material (e.g., plastic, metal, etc.) to provide the desired level of protection and durability. In other forms, the cover may not include a keyboard (14) or other input device, such that the primary function of the cover is to protect and shield the covered display.

Figure 5:
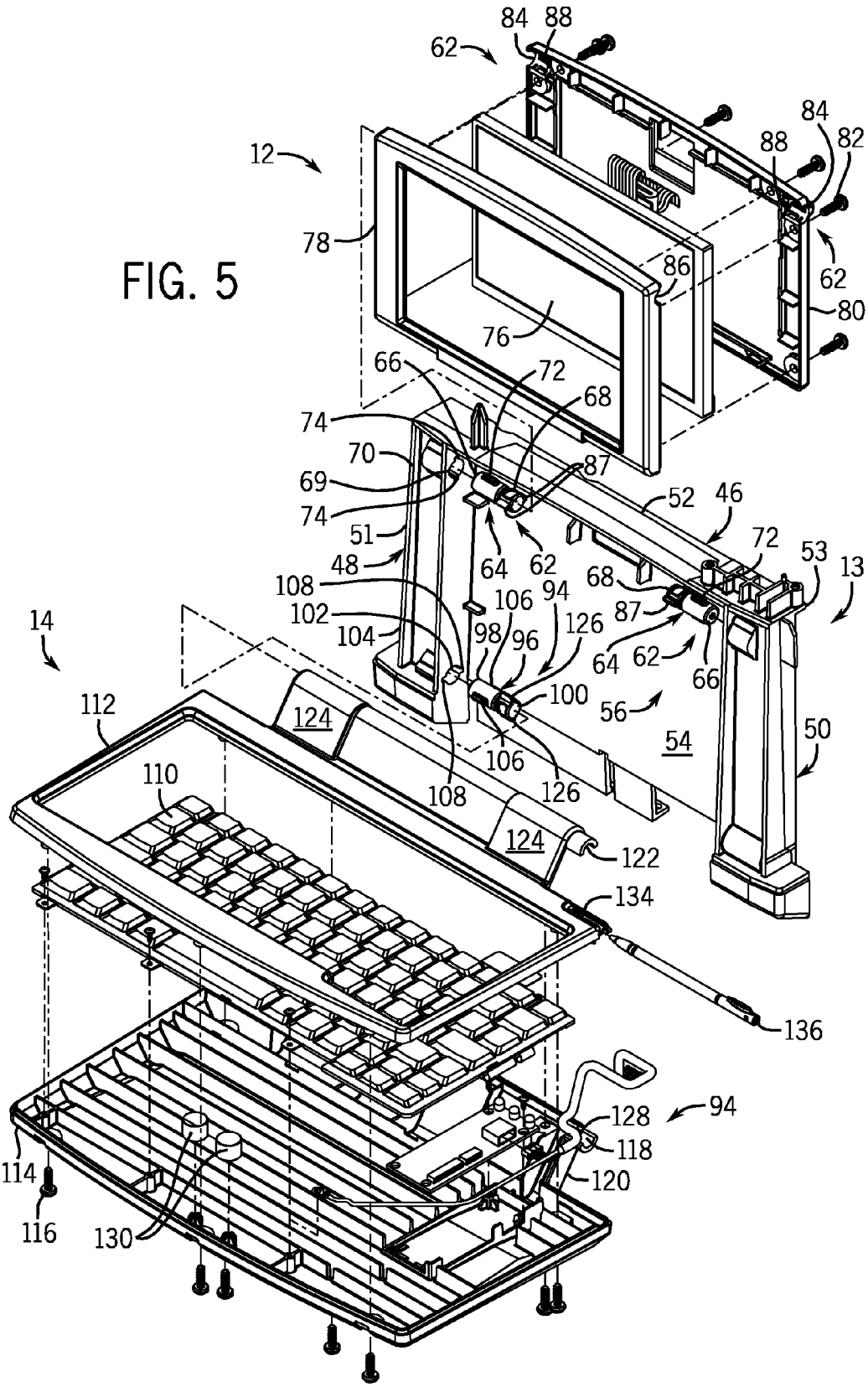
FIG. 5 is an isometric, exploded view of a portion of the example printer illustrated in FIG. 1 showing an example pivot assembly.

With additional reference to FIG. 5, an example pivot assembly (13) is depicted that establishes the pivotal movement and overlap of the example display (i.e., the touchscreen display (12)) and the example cover (i.e., the keyboard (14)). In the example embodiment, the body (16) of the printer (10) defines a side (44) that is oriented substantially perpendicular to the end face (29) and generally adjacent to the pivotally coupled touchscreen display (12) and the pivotally coupled keyboard (14). The example printer (10) also includes a frame (46) that is secured to the housing (20). The frame (46) includes a left leg (48) and a right leg (50) coupled at respective upper ends (51, 53) by a cross member (52). A back plate (54) extends between the left leg (48), the right leg (50), and the cross member (52), such that the frame (46) defines a recess (56) in the side (44) of the printer (10). The recess (56) is sized to receive the touchscreen display (12) when the touchscreen display (12) is moved into the storage position (e.g., see FIG. 3) to nest within the recess (56). In one alternative construction, the recess (56) may be, for instance, integrally formed with the side (44) of the printer (10).

The structure and operation of the example pivotal touchscreen display (12) and the example pivotal keyboard (14) are further described with reference to FIGS. 1A and 3-7. Beginning with the touchscreen display (12), the touchscreen display (12) is pivotally coupled to the body (16) adjacent to the side (44), and specifically is pivotally coupled to the frame (46), about a display axis (58) (best shown in FIGS. 1A, 3, 5, and 6). The touchscreen display (12) is thus moveable between the storage position (best illustrated in FIGS. 2 and 3), at which the touchscreen display (12) is substantially adjacent to the body (16), and the viewable position (best illustrated in FIGS. 1A and 1B), at which the touchscreen display (12) is skewed relative to the body (16). The example touchscreen display (12) further defines a display plane (60) (i.e., a plane substantially perpendicular to the display axis (58), coplanar with the display axis (58), and bisecting the touchscreen display (12) (shown only in FIG. 1B)). When the touchscreen display (12) is in the storage position, the display plane (60) is substantially adjacent to the body (16), and when the touchscreen display (12) is in the viewable position, the display plane (60) is skewed relative to the body (16).

Figure 6:
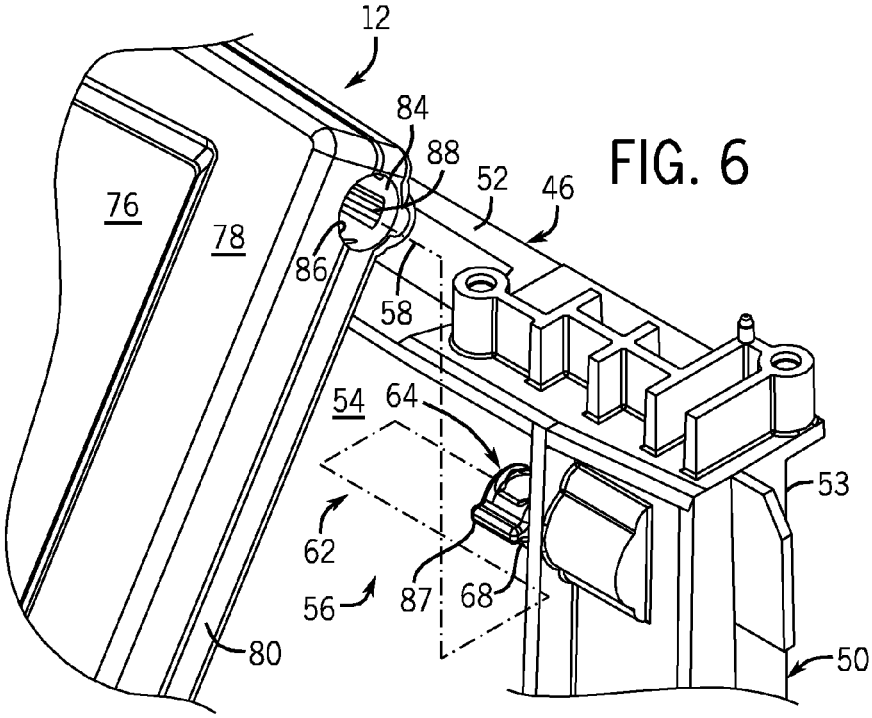
FIG. 6 is an isometric view of a portion of the example pivot assembly illustrated in FIG. 5 showing an example display hinge structure.

The example touchscreen display (12) is pivotally coupled to the frame (46) of the body (16) through an example display hinge structure (62), which is generally illustrated in FIGS. 5 and 6. The example display hinge structure (62) incorporates a pair of friction hinges (64), each friction hinge (64) comprises a first portion (66) and a second portion (68) that can rotate relative to each other. The relative rotation of the first portion (66) and the second portion (68) is inhibited by internal resistance of the friction hinge (64), which ultimately allows the touchscreen display (12) to be pivoted to and restrained in the storage position, the viewable position, or some intermediate position. Specifically, the first portion (66) of the friction hinge (64) is inserted into a generally cylindrical cavity (69) that is coaxial with the display axis (58) and formed in an upper portion (70) of the left leg (48) of the frame (46). To prevent rotation of the first portion (66) of the friction hinge (64) relative to the frame (46), the first portion (66) includes a pair of opposing tabs (72) that extend radially outward and are sized to engage mating channels (74) formed in the cavity (69). As a result, when the first portion (66) is seated and rotationally restrained in the cavity (69), the second portion (68) may rotate relative to the first portion (66).

The second portion (68) of the friction hinge (64) is then rotatably coupled to the touchscreen display (12), such that the touchscreen display (12) can be pivoted about the display axis (58). In the example embodiment, the second portion (68) is captured by the touchscreen display (12). Specifically, the touchscreen display (12) includes a screen (76) seated between a front frame (78) and a rear panel (80). The rectangular front frame (78) and rear panel (80) are coupled by fasteners (82); however, before the front frame (78) and the rear panel (80) are engaged, the second portion (68) of the friction hinge (64) is seated in a rear cavity (84) formed in the rear panel (80). The rear cavity (84) generally defines half of a cylindrical cavity (i.e., a cylinder bisected along a longitudinal, central axis). A front cavity (86) is formed in the front frame (78) and defines the other half of the cylindrical cavity, such that when the rear panel (80) and the front frame (78) are coupled, the rear cavity (84) and front cavity (86) align to capture the second portion (68) of the friction hinge (64) along the display axis (58). Rotation of the second portion (68) relative to the touchscreen display (12) is similarly restrained by a pair of opposing tabs (87) that extend radially outward from the second portion (68) and are sized to engage mating channels (88) formed in the front cavity (86) and the rear cavity (84).

While a single friction hinge (64) may be incorporated to establish pivotal movement of the touchscreen display (12), the example embodiment includes a second friction hinge (64) that is engaged with the touchscreen display (12) and the right leg (50) of the frame (46) in the same manner described with reference to the left leg (48).

Turning to the keyboard (14), the keyboard (14) is pivotally coupled to the body (16) similar to that described with reference to the touchscreen display (12). The keyboard (14) is pivotally coupled to the body (16) adjacent to the side (44), and specifically is pivotally coupled to the frame (46), about a cover axis (90) (best shown in FIGS. 1A, 4, 5, and 7). In the example embodiment, the display axis (58) and the cover axis (90) are oriented such that the display axis (58) and the cover axis (90) are substantially parallel; however, as one skilled in the art will appreciate given the benefit of this disclosure, if the movement of the touchscreen display (12) and the keyboard (14) define respective axes, the axes need not be oriented parallel. For instance, a cover may be configured to pivot about a cover axis that is collinear with a display axis by, for example, providing an inner pivot assembly directing the pivotal movement of the display and an outer pivot assembly directing the pivotal movement of the cover. In this instance, the cover must be pivoted up prior to pivoting up the display.

The keyboard (14) is moveable between the transport position (illustrated in FIG. 4), at which the keyboard (14) is substantially adjacent to the body (16), and the control position (best illustrated in FIGS. 1A, 1B, and 3), at which the keyboard (14) is skewed relative to the body (16) such that the keyboard (14) is substantially perpendicular to the side (44). The example keyboard (14) further defines a cover plane (92) (i.e., a plane substantially perpendicular to the cover axis (90), coplanar with the cover axis (90), and bisecting the keyboard (14) (shown only in FIG. 1B)). When the keyboard (14) is in the transport position, the cover plane (92) is substantially adjacent to the body (16), and when the keyboard (14) is in the control position, the cover plane (92) is skewed relative to the body (16).

Figure 7:
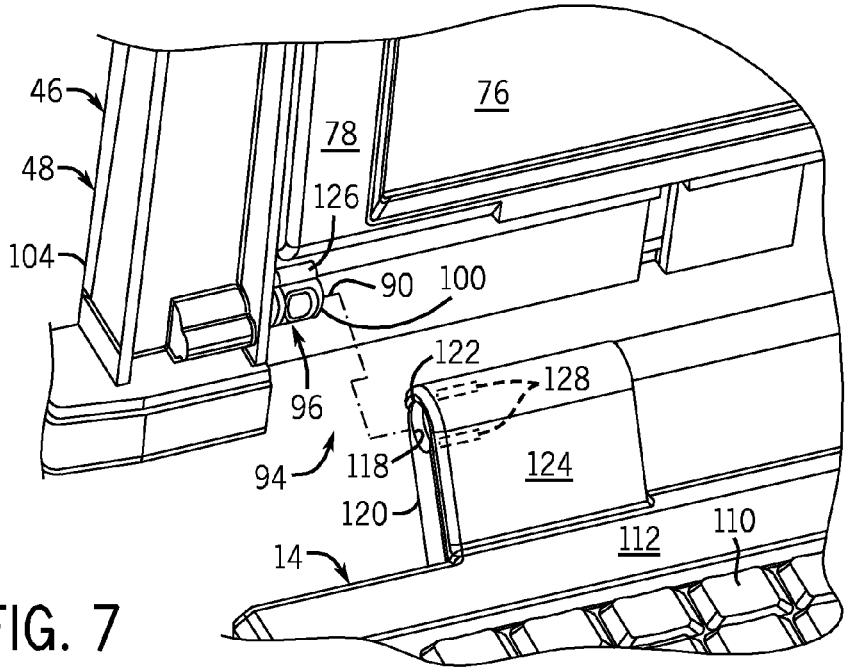
FIG. 7 is an isometric view of a portion of the example pivot assembly illustrated in FIG. 5 showing an example cover hinge structure.

The example keyboard (14) is pivotally coupled to the frame (46) of the body (16) through an example cover hinge structure (94), which is generally illustrated in FIGS. 5 and 7. The example cover hinge structure (94) incorporates a pair of friction hinges (96) (similar to the friction hinges (64) described with respect to the touchscreen display (12)), only one of which is illustrated. Again, each friction hinge (96) comprises a first portion (98) and a second portion (100) that can rotate relative to each other. The relative rotation of the first portion (98) and the second portion (100) is inhibited by internal resistance of the friction hinge (96), which ultimately allows the keyboard (14) to be pivoted to and restrained in the transport position, the control position, or some intermediate position.

The first portion (98) of the friction hinge (96) is inserted into a generally cylindrical cavity (102) that is coaxial with the cover axis (90) and formed in a lower portion (104) of the left leg (48) of the frame (46). To prevent rotation of the first portion (98) of the friction hinge (96) relative to the frame (46), the first portion (98) includes a pair of opposing tabs (106) that extend radially outward and are sized to engage mating channels (108) formed in the cavity (102). As a result, when the first portion (98) is seated and rotationally restrained in the cavity (102), the second portion (100) may rotate relative to the first portion (98).

The second portion (100) of the friction hinge (96) is then rotatably coupled to the keyboard (14), such that the keyboard (14) can be pivoted about the cover axis (90). In the example embodiment, the second portion (100) is captured by the keyboard (14). Specifically, the keyboard (14) includes a key pad (110) seated between a top frame (112) and a bottom panel (114). The rectangular top frame (112) and bottom panel (114) are coupled by fasteners (116); however, before the top frame (112) and the bottom panel (114) are engaged, the second portion (100) of the friction hinge (96) is seated in a bottom cavity (118) that is formed in a bottom hinge arm (120) extending from the bottom panel (114). The bottom cavity (118) generally defines half of a cylindrical cavity (i.e., a cylinder bisected along a longitudinal, central axis). A top cavity (122) is formed in a top hinge arm (124) that extends from the top frame (112) and defines the other half of the cylindrical cavity, such that when the bottom panel (114) and the top frame (112) are coupled, the bottom cavity (118) and top cavity (122) align to capture the second portion (100) of the friction hinge (96) along the cover axis (90). Rotation of the second portion (100) relative to the keyboard (14) is similarly restrained by a pair of opposing tabs (126) that extend radially outward from the second portion (100) and are sized to engage mating channels (128) formed in the top cavity (122) and the bottom cavity (118).

While a single friction hinge (96) may be incorporated to establish pivotal movement of the keyboard (14), in the example embodiment, a second friction hinge (96) is engaged with the keyboard (14) and the right leg (50) of the frame (46) in the same manner described with reference to the left leg (48).

The friction hinge(s) (64, 96) may be similar to the 20-XXX series ReellTorq Inserts supplied by Reell Precision Manufacturing of Saint Paul, Minn. In one embodiment, the friction hinges (64, 96) may call for approximately 0.4 Nm (3.5 Lb-in) of torque to induce relative rotation between the respective first portions (66, 98) and the second portions (68, 100). As one skilled in the art will appreciate, given the benefit of this disclosure, the application-specific requirements will direct the appropriate selection and implementation of the friction hinge(s) or any other suitable device.

The movement and positioning of the touchscreen display (12) and the keyboard (14) may also be influenced by one or more other structures, such as a series of detents, springs, locks, and the like that restrain the touchscreen display (12) in the storage position, the viewable position, or any intermediate position between the extremes, and that restrain the keyboard (14) in the control position, the transport position, or some intermediate position between the extremes. For example, a spring-loaded hook may be captured in the keyboard (14) and configured to selectively engage a lip/cavity formed in the housing (20), thereby locking the keyboard (14) in the transport position. In the example printer (10), the keyboard (14) includes a pair of magnets (130) (shown only in FIG. 5) captured between the top frame (112) and the bottom panel (114) such that when the keyboard (14) is oriented in the transport position the keyboard (14) is inhibited from rotational movement about the cover axis (90) by attractive magnetic force between the magnets (130) and a magnetic structure (133) (or additional magnets) located near a top portion (132) of the body (16). As a result, movement of the keyboard (14) from the transport position toward the control position is inhibited, and thus the touchscreen display (12) (i.e., an example display) remains protected behind the keyboard (14) (i.e., an example cover) during shipping, transportation, and storage of the example printer (10).

The keyboard (14) of the example printer (10) also defines a pocket (134) in the top frame (112) that is configured to receive and restrain a stylus (136) (best shown in FIG. 5). The stylus (136) can be used in connection with the touchscreen display (12) (e.g., for handwriting recognition, actuating a printer function via the touchscreen display (12), etc.).

The configuration of the display hinge structure (62) and the cover hinge structure (94) facilitates the relative movement of the touchscreen display (12) and the keyboard (14) of the example printer (10). For example, the printer (10) may be manipulated such that the touchscreen display (12) is positioned between the side (44) of the body (16) and the keyboard (14) when the touchscreen display (12) is pivoted to be substantially parallel with the side (44) in the storage position, and the keyboard (14) is pivoted to overlap the touchscreen display (12) in the transport position. As a result, the keyboard (14) substantially completely overlaps and encases the touchscreen display (12) when the touchscreen display (12) is nested within the recess (56) (i.e., when oriented in the storage position) and the keyboard (14) is oriented in the transport position. In alternative configurations, the keyboard (14) may only partially cover or overlap the touchscreen display (12) (e.g., the keyboard (14) may only cover the screen (76)).

The relative orientation of the touchscreen display (12) and the keyboard (14) may be altered to accommodate particular application-specific requirements. However, in the example printer (10) illustrated and described, when the touchscreen display (12) is in the storage position and the keyboard (14) is in the transport position, the display plane (60) and the cover plane (92) are substantially parallel. And, when the touchscreen display (12) is in the viewable position and the keyboard (14) is in the control position, the display plane (60) and the cover plane (92) intersect to define an obtuse angle (best shown in FIGS. 1A and 1B).

While the example embodiment includes a display in the form of a touchscreen display interface, the display may comprise any other suitable device, such as liquid crystal display (i.e., a display not having any touch capability), a plasma display, and the like. Similarly, while the example embodiment includes a cover in the form of a keyboard, the cover may comprise any other suitable device, such as a protective panel (i.e., without input/interface capability), a touchscreen display interface, a touchpad interface, a trackball interface, and the like.

Given the benefit of this disclosure, one skilled in the art will appreciate various modifications to the above concepts that may be made. For instance, the display may be pivotally coupled to the body (16) by a display ball-socket structure (e.g., a socket formed on the body (16) may be configured to receive a ball formed on the display, thereby establishing pivotal coupling). Similarly, the cover may be pivotally coupled to the body (16) by a cover ball-socket structure (e.g., one or more balls may be formed on the body (16) and configured to be received in mating sockets formed on the cover). The ball-socket structure may be sized to provide a friction/interference fit when the ball(s) is/are seated in the socket(s), thereby inhibiting movement of the respective display and cover from desired positions. Furthermore, if a single ball and a single socket are incorporated to provide pivotal movement, the ball may include a post extending radially from the ball and the socket may include a radial slot in which the post is guided during pivotal movement, thus establishing relative rotation perpendicular to the post if additional rotational freedom is not desired.

While there has been shown and described what is at present considered the preferred embodiments, it will be appreciated by those skilled in the art, given the benefit of this disclosure, that various changes and modifications can be made without departing from the scope of the invention defined by the following claims.

We claim:

1. A printer, comprising:

a body;

a display pivotally coupled to the body and moveable between a storage position and a viewable position; and a cover pivotally coupled to the body and moveable between a transport position and a control position;

wherein the cover overlaps the display when the display is in the storage position and the cover is in the transport position.

2. The printer of claim 1, wherein the body comprises at least one of a frame of the printer and a housing of the printer.

3. The printer of claim 1, wherein:

the display comprises at least one of a touchscreen display interface, a liquid crystal display, and a plasma display; and the cover comprises at least one of a keyboard, a protective panel, a touchscreen display interface, a touchpad interface, and a trackball interface.

4. The printer of claim 1, wherein:

the display is pivotally coupled to the body about a display axis;

the cover is pivotally coupled to the body about a cover axis; and the display axis and the cover axis are substantially parallel.

5. The printer of claim 4, wherein the display axis and the cover axis are substantially collinear.

6. The printer of claim 1, wherein:

the display is pivotally coupled to the body by at least one of a display hinge structure and a display ball-socket structure; and the cover is pivotally coupled to the body by at least one of a cover hinge structure and a cover ball-socked structure.

7. The printer of claim 1, wherein at least one of the cover and the body includes a magnet to inhibit movement of the cover from the transport position toward the control position.

8. The printer of claim 1, further comprising a friction hinge coupling the display and the body to inhibit movement of the display between the storage position and the viewable position.

9. The printer of claim 1, wherein:

the body defines a side; and the display is positioned between the side and the cover when the display is in the storage position and the cover is in the transport position.

10. The printer of claim 1, wherein:

the body defines a side; and a recess is defined by the side to receive the display when the display is in the storage position.

11. The printer of claim 1, wherein:

the body defines a side;

the display is skewed relative to the side when the display is in the viewable position; and the cover is substantially perpendicular relative to the side when the cover is in the control position.

12. The printer of claim 1, wherein the cover substantially completely overlaps the display when the display is in the storage position and the cover is in the transport position.

13. The printer of claim 1, wherein:

the display defines a display plane, the display is pivotally coupled to the body to pivot between the storage position and the viewable position;

the cover defines a cover plane, the cover is pivotally coupled to the body to pivot between the transport position and the control position;

when the display is in the storage position and the cover is in the transport position, the display plane and the cover plane are substantially parallel such that the cover overlaps the display; and when the display is in the viewable position and the cover is in the control position, the display plane and the cover plane intersect to define an obtuse angle.

14. The printer of claim 13, wherein the cover substantially completely overlaps the display when the display is in the storage position and the cover is in the transport position.

15. The printer of claim 13, wherein:

when the display is in the storage position, the display plane is substantially adjacent to the body;

when the display is in the viewable position, the display plane is skewed relative to the body;

when the cover is in the transport position, the cover plane is substantially adjacent to the body; and when the cover is in the control position, the cover plane is skewed relative to the body.

16. A printer, comprising:

a body defining a side;

a display pivotally coupled to the body adjacent to the side; and a cover pivotally coupled to the body adjacent to the side;

wherein the display can be pivoted to be substantially parallel with the side; and wherein the cover can be pivoted to overlap the display such that when the display is substantially parallel with the side the display is positioned between the side of the body and the cover.

17. The printer of claim 16, wherein:

the display is pivotally coupled to the body to pivot about a display axis;

the cover is pivotally coupled to the body to pivot about a cover axis; and the display axis and the cover axis are substantially parallel.

18. The printer of claim 16, wherein the cover can be pivoted to substantially completely overlap the display such that when the display is substantially parallel with the side the display is substantially encased between the side and the cover.

19. The printer of claim 16, wherein:

the display is pivotally coupled to the body to pivot between a storage position, at which the display is substantially adjacent to the body, and a viewable position, at which the display is skewed relative to the body; and the cover is pivotally coupled to the body to pivot between a transport position, at which the cover is substantially adjacent to the body, and a control position, at which the cover is skewed relative to the body.

20. A printer, comprising:

a body having a side and an end face that is oriented substantially perpendicular to the side;

a recess defined in the side;

a media output passage defined in the end face;

a touch screen display having a screen and a rear panel adjacent to the screen, the touch screen display is pivotally coupled to the body adjacent to the side; and a keyboard having a key pad and a bottom panel adjacent to the key pad, the keyboard is pivotally coupled to the body adjacent to the side;

wherein the touch screen display is moveable between a storage position at which the touch screen display is at least partially received in the recess, and a viewable position at which the touch screen display is skewed relative to the side;

wherein the keyboard is moveable between a transport position at which the keyboard is adjacent to the side, and a control position at which the keyboard is skewed relative to the side; and wherein when the touch screen display is in the storage position and the keyboard is in the transport position the rear panel is adjacent to the recess and the key pad is adjacent to the screen such that the keyboard overlaps and at least partially encases the touch screen display in the recess between the side of the printer and the bottom panel of the keyboard.

* * * * *